US005974923A

United States Patent [19]

Rigby, Jr. et al.

[11] Patent Number: 5,974,923

[45] Date of Patent: Nov. 2, 1999

[54] VENEER COMPOSER AND CLIPPER APPARATUS

[75] Inventors: Donald M. Rigby, Jr., Lake Oswego; William J. Wall, Keizer; Lawrence L. Payne, Mowalla; Scott M. Rigby, Canby; Michael R. Peterson, Cawby, all of Oreg.

[73] Assignee: Panel Equipment Sales, Inc., Portland, Oreg.

[21] Appl. No.: 09/081,886

[22] Filed: May 19, 1998

[51] Int. Cl.[6] ..... B26D 5/20; B27B 1/00

[52] U.S. Cl. ..... 83/76; 83/63; 83/208; 83/211; 83/286; 83/370; 144/2.1; 144/356; 144/357; 144/363

[58] Field of Search ..... 83/63, 76, 208, 83/211, 285, 286, 289, 296, 365, 370, 371; 118/37, 40, 42, 668; 144/1.1, 2.1, 3.1, 356, 357, 363

[56] References Cited

U.S. PATENT DOCUMENTS

| | | | |
|---|---|---|---|
| 1,753,967 | 4/1930 | Robinson | 83/296 |
| 3,029,675 | 4/1962 | Alexander et al. | 83/76 |
| 3,670,614 | 6/1972 | Streckert | 83/208 |
| 3,760,667 | 9/1973 | Maxey et al. | 83/371 |
| 3,774,750 | 11/1973 | Streckert | 83/208 |
| 3,808,925 | 5/1974 | Hards | 83/346 |
| 3,837,250 | 9/1974 | Lumn | 83/424 |
| 3,894,460 | 7/1975 | Lumn | 83/630 |
| 3,946,628 | 3/1976 | VanDerlin | 83/285 |
| 4,351,379 | 9/1982 | Hasegawa | 144/365 |
| 4,397,204 | 8/1983 | Colombo | 83/371 |
| 4,658,684 | 4/1987 | Brookhyser | 83/289 |
| 4,726,271 | 2/1988 | McEwan | 83/159 |
| 4,732,067 | 3/1988 | Yamada . | |
| 4,742,745 | 5/1988 | Cremona . | |
| 4,765,214 | 8/1988 | Nakaya . | |
| 4,781,090 | 11/1988 | Feldkamper et al. | 83/76 |
| 4,809,574 | 3/1989 | Cremona | 83/371 |
| 4,934,228 | 6/1990 | Bolton et al. | 144/3.1 |
| 4,989,651 | 2/1991 | Snellgrove | 144/3.1 |
| 5,235,518 | 8/1993 | Maekawa et al. | 144/350 |
| 5,383,504 | 1/1995 | Cremuna | 144/3.1 |

*Primary Examiner*—W. Donald Bray
*Attorney, Agent, or Firm*—Kolisch, Hartwell, Dickinson, McCormack & Heuser

[57] ABSTRACT

A composer clipper apparatus that includes a composer for producing a composed ribbon of veneer from veneer pieces disposed edge-to-edge. A conveyor system transports the ribbon of veneer downstream from the composer. The ribbon of veneer is cut into sheets of predetermined length at a clipping station downstream from the composer. A sensor sensing a cut lead edge in the ribbon of veneer, and a coordinated tracking device, controls operation of the clipping station.

10 Claims, 3 Drawing Sheets

VENEER COMPOSER AND CLIPPER APPARATUS

BACKGROUND AND SUMMARY OF THE INVENTION

This invention relates to a veneer composer and clipper apparatus usable in the production of veneer sheets of predetermined width cut from a ribbon of veneer made up of veneer pieces of random width secured in edge-to-edge relationship. The apparatus is characterized by a number of features contributing to rapid operation with consistent accuracy in the width of the veneer sheets cut from the ribbon of veneer.

With the apparatus, and because of its speed of operation, and the accuracy in the cuts or clips produced, high production with minimum wastage is possible.

Veneer cut from a log results in a considerable amount of material in the form of veneer pieces of random width frequently having nonparallel opposite edges and including defective regions that should be trimmed from the pieces to produce a satisfactory product. In the production of plywood from such material, it has been the practice to process such pieces in apparatus known as a composer or welder, where the pieces are laid out side-by-side and the pieces then clipped or trimmed to remove defective areas and to produce veneer pieces having parallel opposite edges. Hot melt glue is then applied across the edges of the veneer pieces, and the pieces then pressed tightly against each other to form a continuous ribbon. Additionally, adhesive impregnated strings are applied across one of the faces of the ribbon so produced further to hold the veneer pieces securely to each other.

A veneer ribbon prepared as above generally described may be traveling from the region of the composer where the ribbon of veneer is consolidated while moving at a preselected line speed for the apparatus, with such movement subject to random stoppage at such times as waste is discarded or other events occur requiring that the assembled veneer ribbon stop its forward travel to enable other material to join with the ribbon to form a continuous piece.

In the production of plywood, the continuous ribbon of veneer produced in the composer is subjected to a final clipping operation as a clipper which cuts the ribbon of veneer into individual sheets having a size, i.e. width, conforming to that required by the plywood producer. To obtain maximum production, it is important that this clipper be capable of cutting "on the fly," i.e. without stopping movement of the continuous ribbon passing into the clipper. It is also important that the clipper be controlled in such a manner that a cut is produced only at such time as an exact amount of veneer has moved beyond the clipper, so as to produce a sheet of exact predetermined width when the cut is produced. With the conditions above described, the tracking of material traveling through the clipper must be accurately done, irrespective of stoppage in the movement of material and different time lapses when stoppages occur. Further, optimally, the control system should be accurate even with relatively rapid line speeds in the accumulator, if maximum production is to be obtained.

A general object of the invention is to provide a novel accumulator-clipper apparatus which is capable of producing rapidly and accurately veneer sheets of preselected edge-to-edge dimension from a veneer ribbon moving irregularly at line speed as above described.

As discussed above, in the making of a veneer ribbon in the accumulator, string or thread expanses are secured across one face of the forming veneer ribbon as part of the system holding the veneer pieces together. It is important that clipping be done in such a manner that complete cuts are produced. Following the invention, a rotary clipper is used to produce a cut, and the knife or blade making a cut moves first through the string expanses holding the veneer pieces together and then through the veneer, where such is backed by a back-up anvil roll. In this way, a complete and accurate cutting of the string expanses is assured.

A further feature and object is to provide, in apparatus as above described, roll surfaces in cooperating anvil and clipper rolls cooperating to provide a guide channel or throat guiding material for forward travel in intervals when cuts are not being performed.

A further object of the invention is to provide, in a composer-clipper apparatus, a control system which is relatively trouble free and easily maintained in operating order by the usual personnel provided to operate the equipment.

BRIEF DESCRIPTION OF THE DRAWINGS

These and other objects and advantages are attained by the invention, which is described herein below in conjunction with the accompanying drawings, wherein.

DETAILED DESCRIPTION OF THE PREFERRED EMBODIMENT

Figure 1:
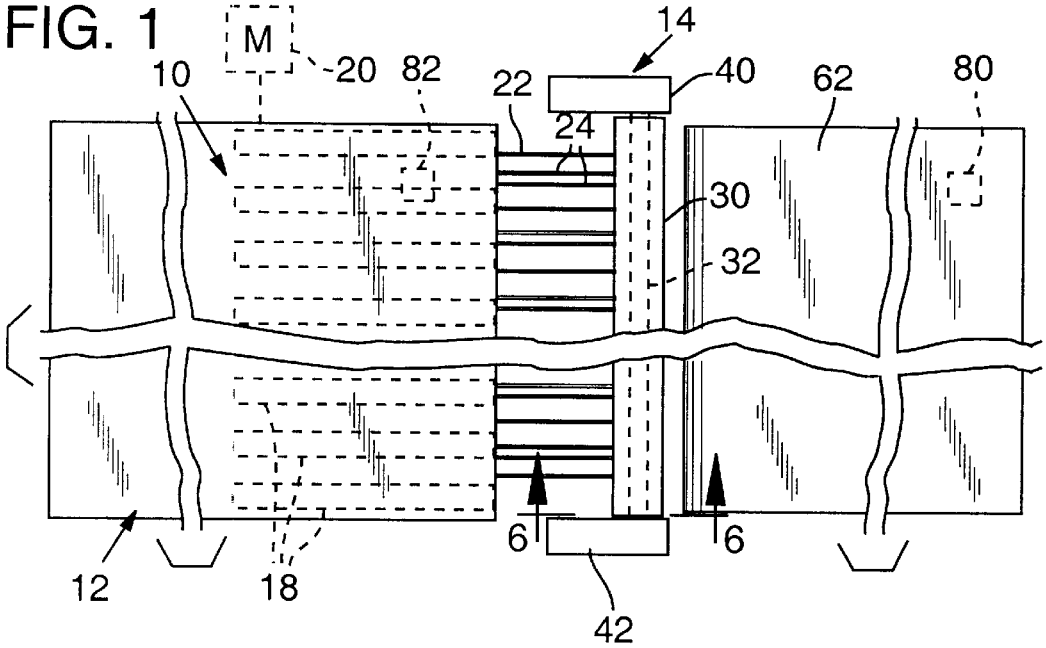
FIG. 1 is a simplified plan view, partially in diagrammatic form, illustrating composer-clipper apparatus as contemplated herein.

Referring now to the drawings, and more particularly to FIG. 1, the composer-clipper apparatus of the invention is illustrated generally at 10. In such apparatus, the composer is represented generally by the rectangular outline shown at 12, and the clipper is indicated generally by the structure shown at 14.

The composer may have a conventional construction. Describing a typical composer, such normally includes a source of rough veneer pieces, such as a tilt table and the like, from which an operator selects and feeds sheets to be processed by the composer. The veneer pieces may have non-squared edges and defect regions requiring trimming prior to the veneer pieces being formed into a continuous ribbon. The veneer pieces on traveling through the composer are clipped to remove defects and to produce leading and trailing edges that are parallel and squared up in the piece. After this clipping operation, hot melt glue is applied at appropriate points across the leading edges of the veneer pieces traveling through the composer, and the veneer pieces are crowded edge-to-edge and against each other to form a continuous ribbon of veneer. For the purpose of further holding the veneer pieces together, adhesive impregnated strings are bonded to the under face of the forming veneer ribbon, these strings being laterally spaced from each other and generally paralleling the length of the ribbon under construction. In FIG. 1, the continuous ribbon of veneer as such is made extends from left to right and towards clipper 14. The veneer pieces that form the ribbon of veneer have grain extending generally transversely of this direction.

The ribbon of material formed in the composer is carried through the composer on a line conveyor, represented in FIG. 1 by the conveyor chain runs designated at 18. Movement of the material is in essentially a horizontal path. The chains of the line conveyor carry the material at a line speed, which in a typical installation might be within the range of 110 to 140 feet per minute. Movement of the chains is not continuous, however, with movement of the chains stopped at random intervals during the edge and defect clipping at the primary clipper. This stoppage of line speed is composer controlled stoppage and produced by controls in the composer sensing when stoppage is necessary to bring about proper edge-to-edge crowding.

Chains 18 of the line conveyor are rotated under power through operation of a motor 20.

The continuous ribbon of veneer leaving the composer travels forwardly, or in an off-bearing direction, to advance between lower and upper transfer rails 22, 24 in a rail conveyor section located directly in advance of the rotary clipper. From thence the veneer ribbon is directed into a throat or guide region R (see FIG. 6) defined between the smooth peripheral surfaces of an upper anvil roll 30 and a clipper roll 32 provided in clipper 14. By way of example, when processing veneer of ¼" thickness, this throat region might have a width of ⅜" . The smooth surfaces of the anvil and clipper rolls function to guide the veneer material in its movement in an off-bearing direction.

Anvil roll 30, as well as underlying clipper roll 32 and a lower anvil roll indicated at 34, are suitably rotatably supported in end stands 40, 42 (see FIG. 1) of the clipper, with the axes of the rolls paralleling each other and extending transversely of the ribbon of veneer. The anvil rolls preferably are covered with a polyurethane covering layer, shown for the rolls at 31 and 35.

Figure 6:
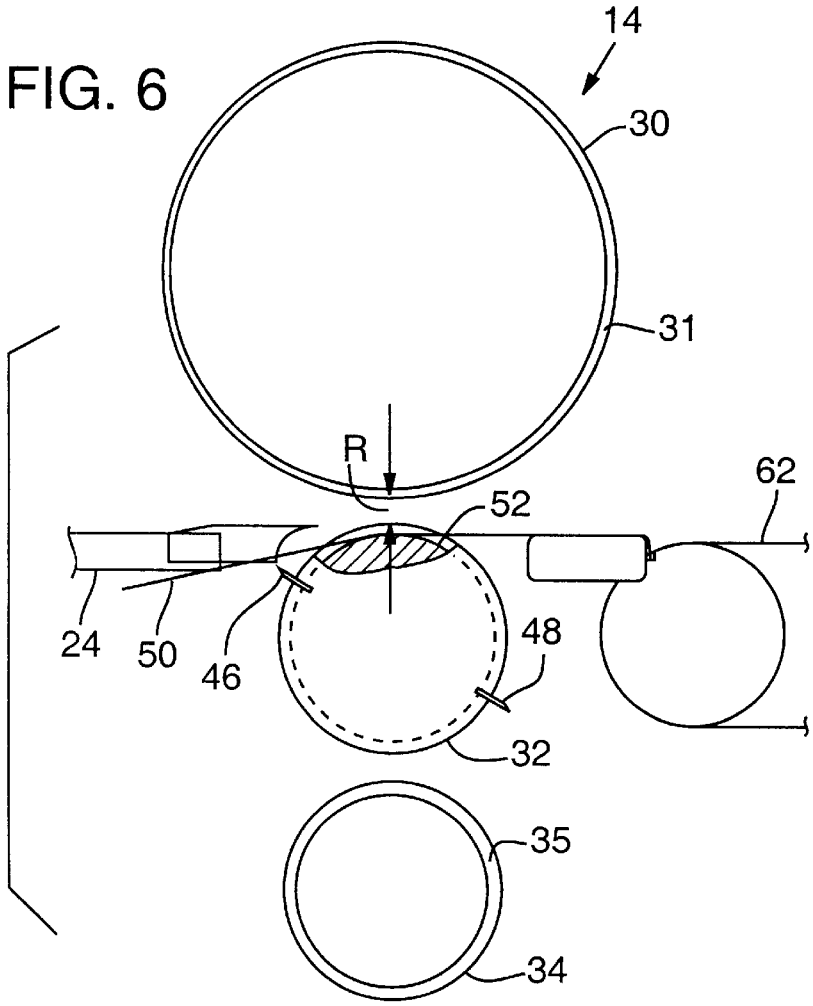
FIG. 6 is a view, simplified and somewhat enlarged, taken generally along the line 6—6 in FIG. 1, further illustrating details of the clipper in the apparatus.
Figure 2:
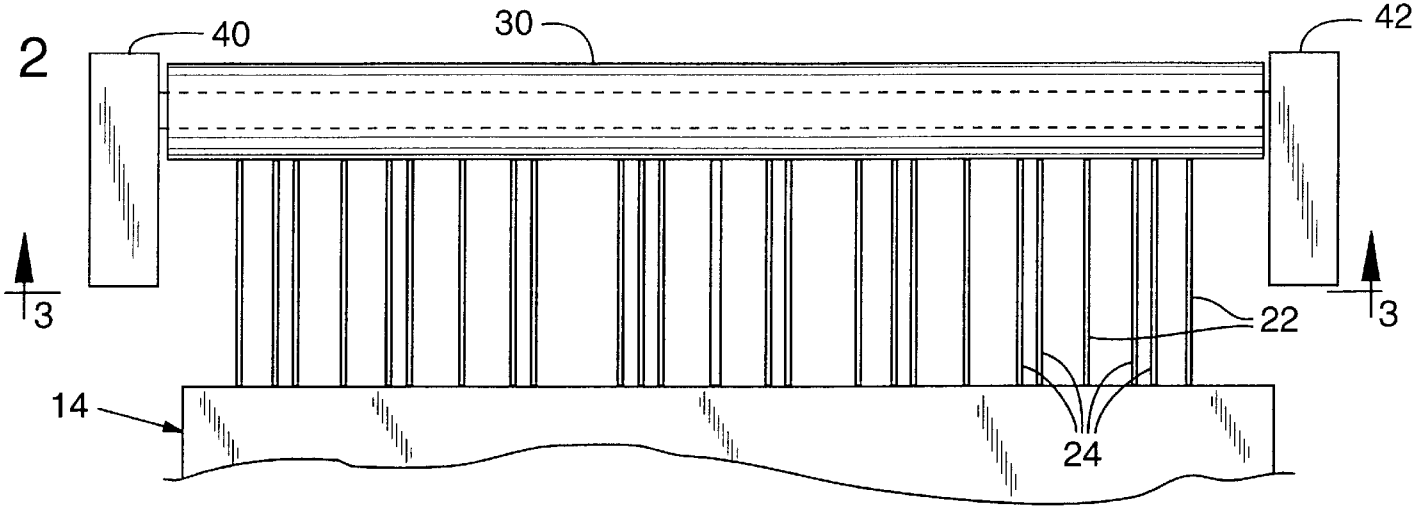
FIG. 2 is a somewhat enlarged view of a portion of the apparatus illustrated in FIG. 1 that contains a clipper.
Figure 3:
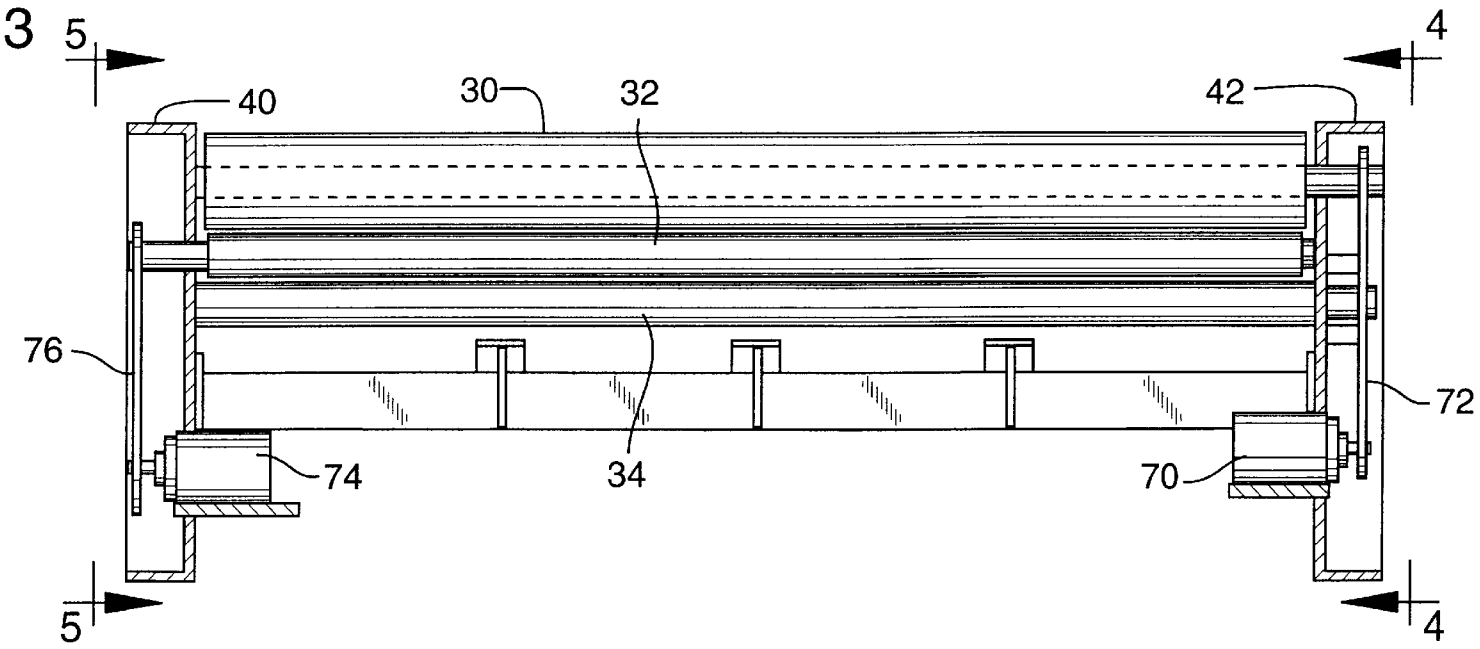
FIG. 3 is a view taken generally along the line 3—3 in FIG. 2.

In the embodiment illustrated, and again referring to FIG. 6, the clipper roll has two elongate knife structures mounted on diametrically opposite sides of the roll, shown at 46, 48. As illustrated in FIG. 6, knife structure 46 is approximately at a 10 o'clock position, and knife structure 48 at approximately a 4 o'clock position on the roll. On the roll rotated to produce a cut, the roll is rotated in a clockwise direction an angular distance of 180 degrees. This moves knife structure 46 into the 4 o'clock position as shown for knife structure 48, and knife structure 48 to the 10 o'clock position shown for knife structure 46.

Each knife structure may comprise multiple knife segments disposed end-to-end and in alignment. This contributes to easier mounting and repair of a knife structure.

Also provided for guiding the veneer are guide straps such as the one shown at 50 in FIG. 6. This strap may be received in an appropriate groove or channel 52 in the periphery of the clipper roll. A clearance space left between the adjacent ends of knife segments in a knife structure permits a knife structure to move in unhindered fashion across the guide strap.

The lower anvil roll is provided to provide proper support for the knife structures in the clipper roll when a cut is being performed. Further explaining, when knife structure 46 moves against the underside of material to cut it with the upper side of this material then being supported by the upper anvil roll, at the same time knife structure 48 moves against the lower anvil roll to provide back up support for the clipper roll.

Material after being cut moves on to an out-feed belt conveyor shown generally in FIG. 1 at 60. Such may include belts such as the belt 62 shown in FIG. 6. These belts normally are rotated at a constant speed which is slightly faster than the line speed of line conveyor 16. In this way, a veneer sheet after being cut is pulled away from the ribbon of veneer following it through the clipper.

Figure 4:
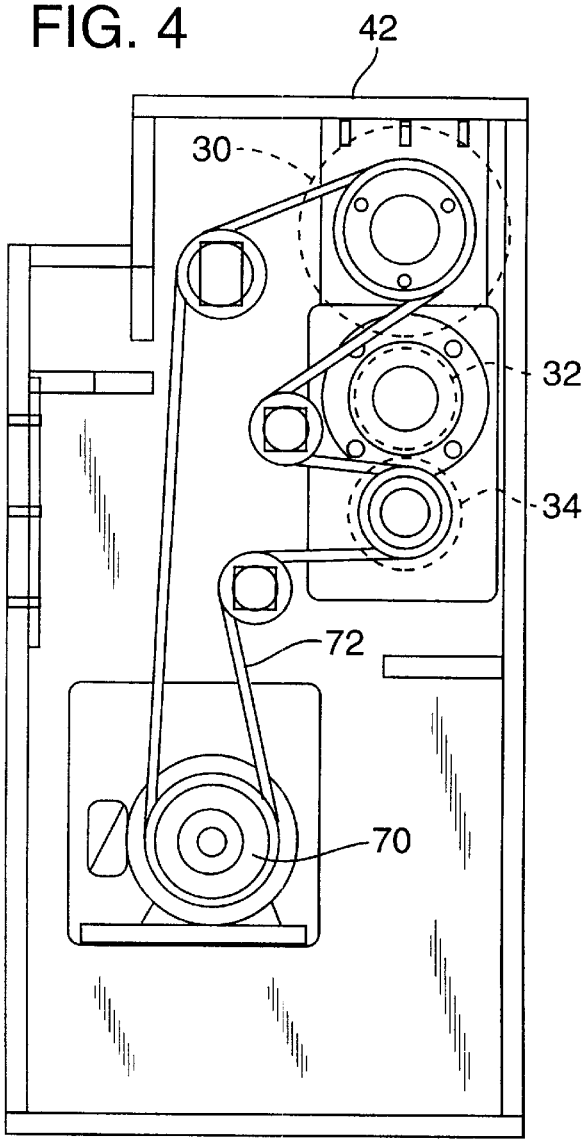
FIG. 4 is a simplified drawing taken generally along the line 4—4 in FIG. 3.
Figure 5:
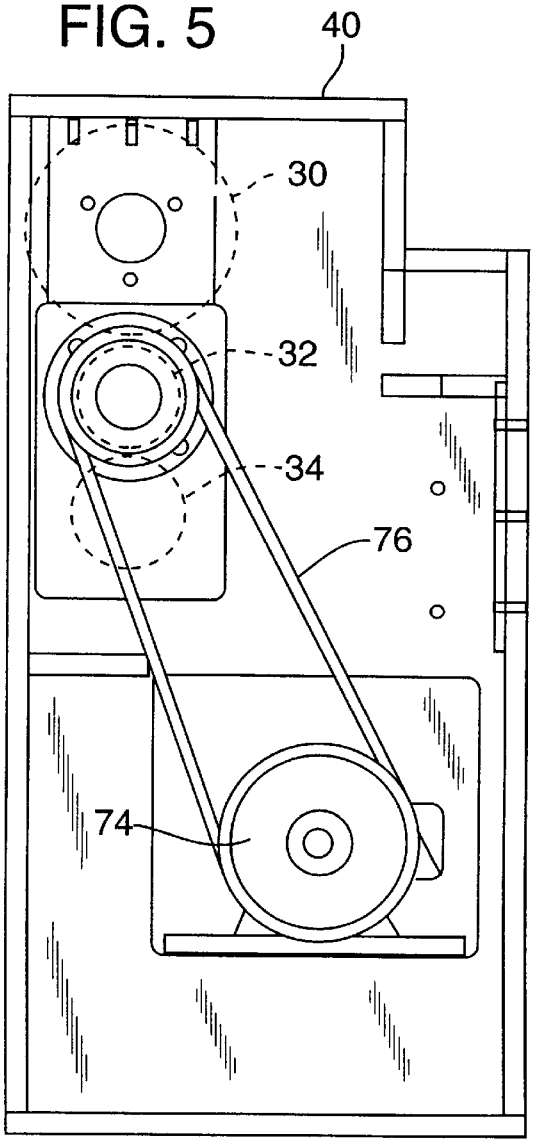
FIG. 5 is a simplified drawing taken generally along the line 5—5 in FIG. 3.

The top and lower anvil rolls, and referring to FIG. 4, are rotated under power by servo motor and gear box 70 and a drive chain 72 extending over suitable sprockets secured to the ends of these rolls. The clipper roll is rotated under power by servo motor and gear box 74, and chain 76 trained over a suitable sprocket secured to the clipper roll.

As earlier described, the continuous ribbon of veneer coming from the composer has edge-butted veneer pieces held in an assembled state by means of glue or adhesive impregnated strings secured to the sheets on the under surface of the ribbon of veneer. This means, and referring to FIG. 6, that on the ribbon of veneer moving into the clipping station or the clipper, on a clip or cut being made, the clipper roll rotates to swing a knife structure against the veneer and string with the knife first moving against the string and then advancing through the string and the veneer to come up against the surface of the upper anvil roll. As a consequence, a complete severing of the string expanses results. The sheets of veneer moving downstream from the clipper may be collected and stacked one over another with their upper exposed faces free of any string expanses. This is the optimum position, for example, with the veneer sheet to be used as a face or core veneer in a plywood panel.

In operation of the apparatus described, the upper and lower anvil rolls are rotated so that the surface speed of these rolls corresponds to the line speed of line conveyor 16. When a cut is not being performed, this line speed as earlier described might be within the range of 110 to 140 feet per minute, and this is the predominant line speed of the apparatus. When making a cut, ordinarily it is preferable that the line speed be reduced to a second somewhat slower line speed. By way of an example, this second line speed might be a speed of 85 feet-per-minute. With this reduction, the rotation speed of the upper and lower anvil rolls would also be reduced to correspond. With the clipper roll rotated to make a cut, the roll is rotated so that its surface speed corresponds to the lower speed of the line conveyor, i.e. 85 feet-per-minute.

Controlling operation of the various conveyors is a photo sensor 80 detecting the leading edge of the ribbon of veneer emerging from the clipper, and a tracking device, more specifically, an encoder 82, located on the in feed side of the clipper, which when activated tracks the amount of material which travels past the device. The sensor 80 and encoder 82, as well as controllers for motor 20 driving the line conveyor and motors 70, 74 powering the anvil rolls and the clipper roll, are interconnected in a common circuit. The operation of the circuit is such that on sensor 80 detecting the lead edge of the veneer ribbon, the tracking device is activated to start tracking the amount of material passing the device in the apparatus. Furthermore, with the photo sensor detecting the lead edge, motors 20 and 70 are actuated to slow their speed (to 85 feet-per-minute in the example herein described) and motor 74 actuated to start rotation of the clipper roll at the speed of 85 feet-per-minute.

If material fed into the clipper and traveling past the encoder continues to be tracked by the encoder, with no stopping of movement occurring as the result of composer controlled stoppage of line speed, the clipper roll will rotate to move the appropriate knife structure from the 10 o'clock position to a position producing a cut and thence to advance the knife structure to the 4 o'clock position. However, if after the tracking device is actuated, the line speed of the materials stops or is interrupted by reason of composer controlled stoppage of line speed, and this is before a cut is produced by the appropriate knife structure, rotation of the clipper roll stops. Movement of the clipper roll is resumed when the tracking device notes resumed movement of the material thereby. A cut will in this manner be produced by the clipper roll with minimum variation in the size of the cut sheet produced caused by reason of interruption in the feed of the ribbon of veneer.

The method of the invention therefore comprises sensing the cut lead edge of the ribbon of material in a zone downstream from the clipper or clipping station. Subsequently and with a tracking device adjusting the tracking device to place it in an operative position whereby it is operable to measure the movement of material thereby and subsequently producing a cut with the clipper with clipper cutting being controlled by the tracking device and the determination by this device that a desired amount of material has passed thereby after the device has been placed in its operative position by the sensor.

The control circuit serves to adjust the tracking device to its inoperative state upon the clipper producing a cut. This readies the device for subsequent adjustment to an operative state upon demand by the sensing device sensing the lead edge of the veneer.

The control circuit also functions to reestablish predominant line speed in the line conveyor and the rotation of the upper and lower anvil rolls after a cut has been produced by the clipper.

While embodiments of the invention have been described, it should be obvious that variations and modifications of the invention are possible. Specific speeds and dimensions have been set forth for illustrative purposes.

It is claimed and desired to secure by Letters Patent:

1. A composer-clipper apparatus comprising:

a composer for producing a composed ribbon of veneer from veneer pieces disposed edge-to-edge, a conveyor system for transporting said ribbon of veneer downstream from the composer along a substantially horizontal path and said path having one side and an opposite side, a clipping station downstream from the composer including a rotatable anvil roll with a rotation axis extending transversely of said path and said roll being located on one side of said path, the clipping station further including an intermittently actuated rotatable knife and mounting structure having a rotation axis extending transversely of said path on said opposite side of said path, a sensor for detecting a leading edge in said ribbon of veneer at a zone located downstream from said clipping station, and a tracking device for measuring travel of said ribbon of veneer connected to said sensor and activated by said sensor, said tracking device controlling actuation of said knife and mounting structure.

2. The composer-clipper apparatus of claim 1, which further includes a power-driven conveyor for moving the ribbon of veneer at a first line speed, and a controller for said conveyor connected to said sensor operable to adjust the conveyor to a second line speed which is slower than the first line speed activated by said sensor.

3. The apparatus of claim 1, wherein said anvil roll is power-rotated, and which further includes a controller for said anvil roll connected to said sensor operable to produce a reduction in the speed of rotation of said roll activated said sensor.

4. A composer-clipper apparatus comprising:

a composer for producing a composed ribbon of veneer from veneer pieces disposed edge-to-edge, a conveyor system for transporting said ribbon of veneer downstream from the composer along a substantially horizontal path, a clipping station downstream from the composer, said clipping station including a rotatable anvil roll with a rotation axis extending transversely of said path disposed above said path, and the station further including an intermittently actuated rotatable knife and mounting structure having a rotation axis extending transversely of said path located opposite said anvil roll on the underside of said path, a sensor for detecting a leading edge in said ribbon of veneer at a zone located downstream from said clipping station, and a tracking device for measuring travel of said ribbon of veneer relative to the device with the tracking device connected to said sensor and placed in an activated state by said sensor, said tracking device controlling actuation of said knife and mounting structure.

5. The apparatus of claim 4, wherein said knife and mounting structure comprises a smooth surfaced clipper roll having at least one knife extending along the length of the roll interrupting the continuity of the roll's smooth surface.

6. A method of cutting on the fly a continuous ribbon of veneer into sheets of preselected length with a clipper where the ribbon of veneer is traveling through the clipper with travel of the veneer ribbon subject to sporadic interruption, the method comprising:

sensing a cut lead edge of the veneer ribbon in a zone downstream from the clipper, providing a tracking station with the station adjustable between operative and inoperative states, the station when in an operative state measuring the amount of veneer ribbon traveling relative to the station, with sensing of the cut lead edge adjusting the tracking station to an operative state, and after adjusting the tracking station to an operative state producing a cut with the clipper with the tracking station having determined that a preselected measured amount of material has traveled relative thereto.

7. The method of claim 6, wherein the tracking station is adjusted to an inoperative state upon the clipper producing a cut to ready the station for a subsequent adjustment to an operative state with the sensing of a cut lead edge.

8. The method of claim 7 wherein travel of the ribbon of veneer occurs at a preselected first line speed and at a preselected second line speed which is slower than the preselected first line speed, and wherein with adjustment of the tracking station to an operative state, travel of the ribbon of veneer is reduced from the first line speed to the slower second line speed.

9. The method of claim 8, wherein upon the clipper producing a cut travel of the veneer is increased from the second line speed to the faster first line speed.

10. Apparatus comprising:

a composer for producing a composed ribbon of veneer from veneer pieces disposed edge-to-edge where the veneer pieces are held together with string expanses extending on the underside of the ribbon of veneer, a crowding rail section for transporting the ribbon of veneer downstream from the composer along a path, a clipping station located downstream from the composer including a smooth-surfaced anvil roll extending transversely of and located directly over said path, the station further including a smooth-surfaced clipper roll located opposite and directly under said path, the ribbon of material being guided along said path through a throat region disposed between said rolls, said clipper roll further including at least one elongate knife structure paralleling the axis of the roll protruding from the periphery of the roll and brought into contact with the anvil roll with rotation of the clipper roll, the knife structure on moving into contact with the anvil roll severing first the string expanses and then the veneer held together by the string expanses.

* * * * *

UNITED STATES PATENT AND TRADEMARK OFFICE

CERTIFICATE OF CORRECTION

PATENT NO. : 5,974,923

DATED : November 2, 1999

INVENTOR(S) : Donald M. Rigby, Jr. et al.

It is certified that error appears in the above-indentified patent and that said Letters Patent is hereby corrected as shown below:

On the cover page

In section [75], line 4, please replace "Cawby" with --Canby--.

Signed and Sealed this

Thirtieth Day of May, 2000

*Attest:*

Q. TODD DICKINSON

*Attesting Officer*

*Director of Patents and Trademarks*